US005335049A

United States Patent [19]

Kanai et al.

[11] Patent Number: 5,335,049

[45] Date of Patent: Aug. 2, 1994

[54] EXHAUST DEVICE FOR PICTURE IMAGE FORMING APPARATUS

[75] Inventors: Makoto Kanai; Kouichi Okabe, both of Saitama, Japan

[73] Assignee: Fuji Xerox Co., Ltd., Tokyo, Japan

[21] Appl. No.: 906,428

[22] Filed: Jun. 30, 1992

[30] Foreign Application Priority Data

Jul. 1, 1991 [JP] Japan ..... 3-186834

[51] Int. Cl.[5] ..... G03G 21/00

[52] U.S. Cl. ..... 355/215; 355/30

[58] Field of Search ..... 355/30, 215, 200, 285, 355/296

[56] References Cited

U.S. PATENT DOCUMENTS

| | | | |
|---|---|---|---|
| 4,050,802 | 9/1977 | Tanaka et al. | 355/215 |
| 4,202,618 | 5/1980 | Waschk et al. | 355/30 X |
| 4,384,783 | 5/1983 | Sakata et al. | 355/285 X |
| 4,540,268 | 9/1985 | Toyono et al. | 355/210 |
| 4,695,146 | 9/1987 | Fuller | 355/30 X |
| 5,081,496 | 1/1992 | Takeda | 355/215 |
| 5,150,154 | 9/1992 | Kuwabara | 355/30 X |

FOREIGN PATENT DOCUMENTS

| | | |
|---|---|---|
| 0403759A3 | 12/1990 | European Pat. Off. . |
| 3942723C1 | 6/1990 | Fed. Rep. of Germany . |
| 60-37574 | 2/1985 | Japan . |

OTHER PUBLICATIONS

European Search Report dated Jan. 28, 1993.

Japan Abstract of Publication No. JP 1007889 Nov. 1,1989, vol. 13, No. 181.

Japan Abstract of Publication No. JP3026179, dated Apr. 2, 1991, vol. 15, No. 152.

Unexamined Japanese Patent Publication No. 37374/1985.

*Primary Examiner*—A. T. Grimley

*Assistant Examiner*—Sandra L. Brase

*Attorney, Agent, or Firm*—Finnegan, Henderson, Farabow, Garrett & Dunner

[57] ABSTRACT

An exhaust device 10, which is arranged on the upper surface of the main unit frame 11 of an electronic copying machine, a printer, or the like, is constructed with a louver 15 having a section in an approximately spherical shape, with an air exhaust fan 18 arranged in the space under the louver 15. Moreover, the louver 15 mentioned above is provided with a large number of slits 16 formed along its arc-shaped structure, and, with these slits 16, the exhaust device can secure an exhaust port even when another object is placed on the louver 15 mentioned above because the slits 16 will not be obstructed completely even in such a case.

2 Claims, 3 Drawing Sheets

EXHAUST DEVICE FOR PICTURE IMAGE FORMING APPARATUS

BACKGROUND OF THE INVENTION

1. Field of the Invention

The present invention relates to an exhaust device for discharging dust, heat, and the like generated inside a picture image forming apparatus, such as an electronic copying machine or a printer, and, more particularly, to such an exhaust device which is constructed in a manner so that the exhaust device is capable of exhausting dust, heat, etc., under conditions even when the exhaust device is positioned in proximity to an outside obstacle or the like.

2. Description of the Related Art

In picture image forming apparatus exemplified by electronic copying machines and printers, recorded paper bearing picture images are produced by an electrophotographic process in which an electrostatic latent image is formed by projecting a beam of picture image light onto a photosensitive material drum and feeding toner from a developing unit to form a picture image in toner on the drum in accordance with the latent image. Thereafter, the toner image is transferred onto printing paper by a picture image transfer device and the toner image bearing printing paper is passed through a fixing device which fixes the toner picture image on the paper and to produce image recorded paper. Apparatus of this type is prone to the development of interior dust and heat and is therefore provided with an exhaust device for discharging the dust and the heat to the exterior of the apparatus.

The dust generated inside the picture image forming apparatus is mainly paper dust from the paper transport system and clouds of toner from the circumference of the photosensitive material drum. In addition to such dust, large amounts of heat and steam, for example, are generated by the fixing device. Also, ozone and NOX (nitrogen oxide) are generated by a charging corotron and a transferring and separating corotron provided in positions facing the photosensitive material drum. The presence of such materials inside the apparatus cause deterioration of parts in the apparatus or otherwise interfere with maintenance-free operation of the apparatus. Moreover, unless the heat generated inside of the apparatus is discharged, the inside of the apparatus will reach high temperatures at which toner deteriorates. Additionally, the heat adversely influences other members, causing impediments to their operation.

Picture image forming apparatus conventionally employ an exhaust system for discharging the heat, dust, or ozone generated from within the apparatus. Dust and ozone filters are usually included to collect the dust and ozone, respectively. Such an exhaust system is disclosed, for example, in Japanese Patent Application Laid Open No. 37574-1985 (Showa 60). In the copying machine described, an exhaust system is arranged for each of upper and lower areas as divided from each other by a paper path in the main unit of the apparatus. These individual exhaust systems respectively discharge the heat generated from lamps and the like provided in the upper part of the apparatus and the heat generated from a power source, for example, in the lower part of the apparatus. These exhaust systems are constructed in such a manner to be capable of performing the exhausting function under favorable conditions, the timing for driving these exhaust systems being set up in accordance with the operating condition of the copying machine.

Conventional exhaust systems for apparatus of the type described employ a louvered register means for discharging the dust and heat through a side wall area of the main frame of a machine. However, the exhaust opening thus provided in a side wall area of a copying machine is often obstructed sufficiently to interfere with effective exhausting operation if the copying machine happens to be placed in a position close to another apparatus, for example, or close to a wall or the like. In order to prevent the occurrence of this problem, it is necessary to set the copying machine in a position spaced from other equipment. However, it is difficult in many cases to secure sufficient space for desks and other items in an office, particularly where a small sized copying machine may be used.

Moreover, it has been proposed, as illustrated in FIG. 9, that a louver 12 should be formed so as to project from a main unit frame 11 in a conventional copying machine like the example given above. The projecting louver 12 shown in FIG. 9 is provided with an exhaust port 13 formed on the upper surface of the projecting part, so that this construction, which clearly indicates the position of the exhaust device 10*d* to the operator, can prevent another object from being placed in a position close to the exhaust device. Yet, even with an exhaust device 10*d* so constructed, it will occasionally happen that the exhaust port of the projecting louver is obstructed if the copying machine is positioned close to a wall or the like. In some cases, such as compact printers, the exhaust port is arranged on the upper part of the apparatus. However, a problem with this construction is that the exhaust device is eventually obstructed with documents or the like placed on the upper area of the printer, which tends to happen in a small office space.

SUMMARY OF THE INVENTION

The present invention has been made in view of the above circumstances and has as an object to provide an exhaust device which is capable of operation even when an obstructing object is placed close to or on the exhaust port of the device.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the exhaust device of this invention is incorporated in a picture image forming apparatus having means for producing recorded paper by transferring a picture image formed in toner on a photosensitive material body by an electrophotographic process onto printing paper and fixing the transferred picture image by passing the printing paper bearing the toner picture image through a fixing device. The particulate dust and heat generated inside the apparatus is discharged to the outside thereof by an exhaust system. The exhaust device is formed in such a manner as to be displaced from the exterior main frame of the apparatus, and includes a louver formed in a curved configuration or in a plurality of planar surfaces. Also, the exhaust device of the invention may be constructed as a concave exhaust part in the main frame of the apparatus.

The exhaust device of the invention is capable of assuring a margin of space for exhaust operation even when an object is in proximity to the exhaust device of the picture image forming apparatus or when the picture image forming apparatus is placed close to a wall or the like. Moreover, a picture image forming apparatus incorporating an exhaust device according to the present invention permits the exhaust device to be located in an arbitrarily selected place on the main frame of the apparatus and the formation of an exhaust path in an arbitrarily determined state. Therefore, the exhaust device according to the present invention is capable of achieving a favorable operating condition for discharging heat, particulate dust, and other harmful substances generated inside the apparatus to the outside thereof in the exhaust air stream.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE INVENTION

Figure 1:
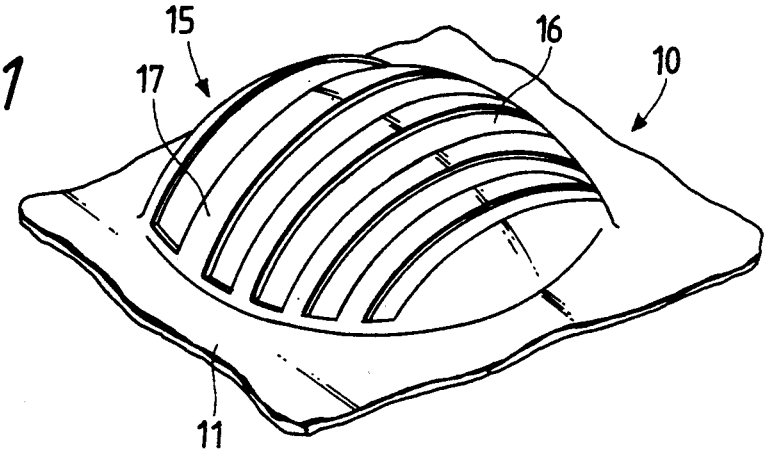
FIG. 1 is a perspective view illustrating the construction of an exhaust device according to the present invention.

The exhaust device of the present invention for use in a picture image forming apparatus will be described with reference to examples of preferred embodiments illustrated in the accompanying drawings, in which like reference characters designate like or corresponding parts throughout the several drawings.

In the description to follow, several exemplary embodiments of the present invention will be described. It should be understood, however, that the present invention is not limited to these embodiments, but may be embodied effectively in other forms to such an extent as will not deviate from the technical scope of the present invention.

Figure 2:
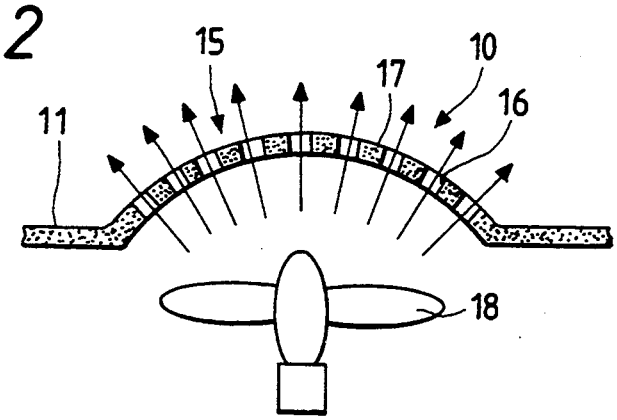
FIG. 2 is a sectional view of the exhaust device shown in FIG. 1.

An embodiment of an exhaust device 10 is illustrated in FIG. 1 and FIG. 2 and represents a form of the present invention in which a louver 15 of approximately spherical shape projects outward from an exterior main frame 11 of a picture image forming apparatus. The louver 15 has slits 16 formed between strip-like members 17, and the slits 16 extend over the entire area of the arc-shaped louver 15. As shown in FIG. 2, exhaust air, discharged by a fan 18 installed in the exhaust device 10, will be discharged through the slits 16 formed in the louver 15 to the exterior of the frame 11. The louver 15 may be set in a side wall of the frame of a picture image forming apparatus, such as a copying machine or a printer, or may be arranged in an arbitrarily selected position on the upper wall of such a picture image forming apparatus. When the louver 15, which is constructed in the manner described above, is arranged on a side wall of the picture image forming apparatus, the convex arc-shaped area of the louver 15 will be kept in relief from a wall or the like, even though a central part of the louver 15 may be obstructed if the exhaust device is placed against a wall or the like. Therefore, the exhaust device can operate to cool the inside of the apparatus in a favorable condition. Furthermore, the exhaust device is located on the top wall of the picture image forming apparatus, this construction of the exhaust device will prevent a complete obstruction of the air exhaust area of the louver 15, even if documents or the like are placed on the upper area of the picture image forming apparatus.

Figure 3:
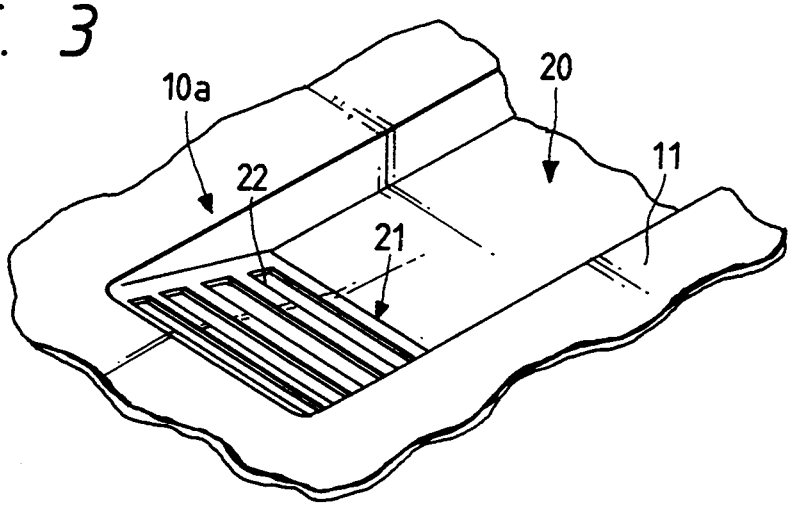
FIG. 3 is a perspective view illustrating the apparatus which is provided with an exhaust device in the form of a concave exhaust part.
Figure 4:
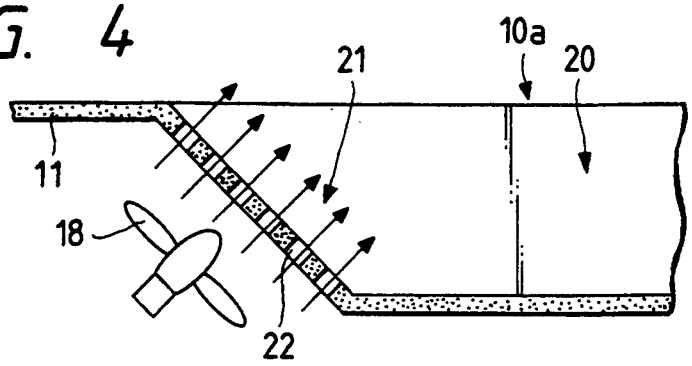
FIG. 4 is a sectional view illustrating the exhaust device shown in FIG. 3.

In another embodiment of the present invention, shown in FIG. 3 and FIG. 4, a concave exhaust part 20 is provided in the main frame 11 of the picture image forming apparatus, and an exhaust device **10*a* includes a louver 21 formed either in the sloped portion (as shown) or the bottom portion of the concave exhaust part 20. The louver 21 is constructed with a large number of slits 22 made in one side wall of the main frame 11, including the concave part 20, and an exhaust air stream is discharged through these slits. Moreover, the concave exhaust part 20** may be formed in a shape extended in an arbitrarily selected direction in relation to the main frame of the picture image forming apparatus, and an exhaust system can be secured by forming an end part of the concave exhaust part, for example, in the shape of a channel reaching to another part of the frame.

Therefore, the exhaust device **10*a* will operate in a favorable condition unless the exhaust device 10*a* is put into a state in which the concave exhaust part 20 is obstructed completely, with the picture image forming apparatus being installed in close contact with a wall or the like. Also, in the case where the channel in the concave exhaust part 20 is extended to a corner part of the apparatus, it is possible to secure an operative exhaust system even if the picture image forming apparatus is in close contact with a wall. Additionally, the exhaust device 10*a* mentioned above permits the louver 21 to be formed in an arbitrarily selected position in the concave exhaust part 20, that is, the louver 21 may be arranged on the sloped portion of the channel part, or may be arranged on the bottom portion of the channel in correspondence with the position of the exhaust fan 18**.

Figure 5:
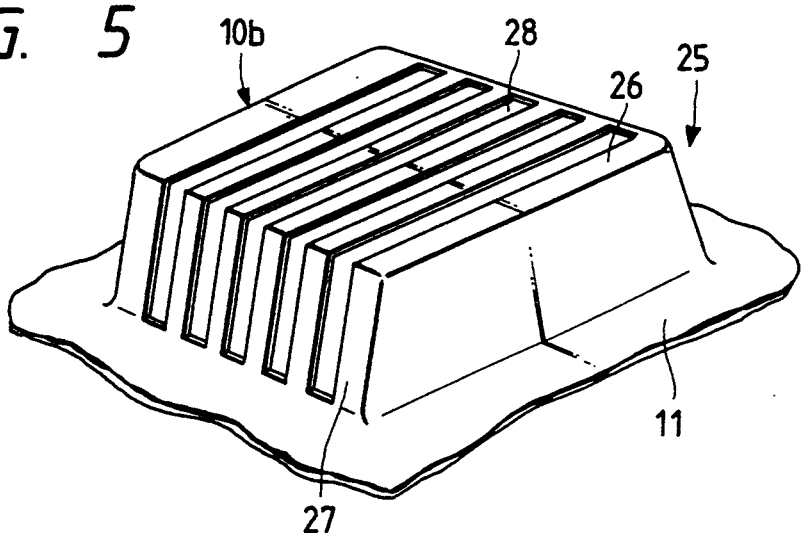
FIG. 5 is a perspective view of the apparatus in which the exhaust device is arranged by means of a projecting louver.
Figure 9:
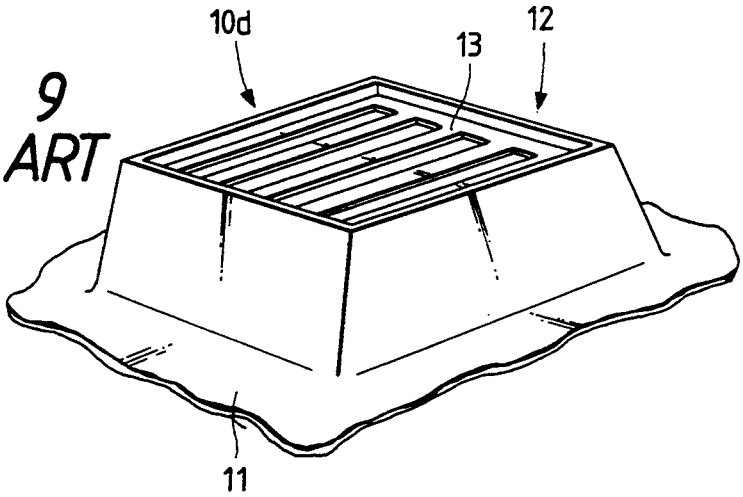
FIG. 9 PRIOR ART
FIG. 9 is a chart illustrating the construction of the conventional exhaust device.

In still another embodiment of the present invention, as illustrated in FIG. 5, an exhaust device **10*b* is constructed with a louver 25 arranged to project outwardly from the main frame 11 in the same way as the example of the conventional exhaust device shown in FIG. 9. The projecting louver 25 has a large number of slits 28 formed in parallel on an upper surface 26 and on a side plate 27 on one side thereof as shown, or on both sides thereof. Because the slits thus extend in a plurality of plane surfaces in the projecting louver 25, as shown in FIG. 5, the exhaust device 10***b* capable of operation through the slits made in one surface even when an object is placed to obstruct the other surface of the projecting louver 25.

Figure 6:
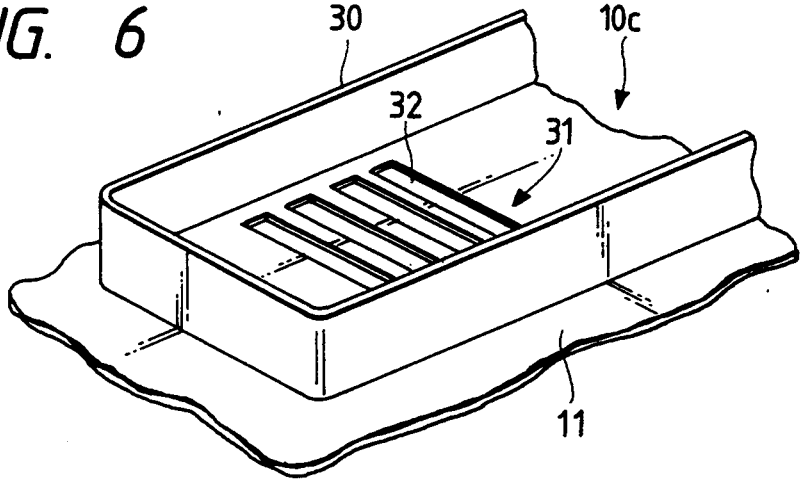
FIG. 6 is a perspective view illustrating the apparatus in which the exhaust device is arranged by means of a frame member.
Figure 7:
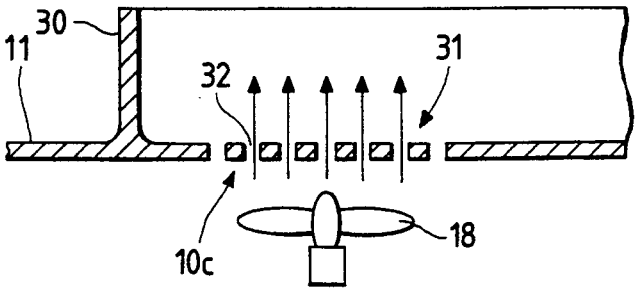
FIG. 7 is a sectional view of the exhaust device shown in FIG. 6.

In addition to the various types of exhaust devices which are constructed as described above, the present invention may be embodied in the construction of an exhaust device 10*c* with a frame member 30 enclosing the circumference of the louver 31 as shown in FIG. 6. In the exhaust device 10*c*, the frame member 30 is fixed to project outward from the main frame 11 of the picture image forming apparatus, and a louver 31 with a large number of slits 32 is arranged in the area thus enclosed with the frame member 30. Thus, with the frame member 30 extended in the lateral direction or in a vertical direction to the exhaust device, it is possible for the exhaust device perform its exhausting operation in a favorable condition unless the entire area thus enclosed by the frame member is obstructed. Moreover, it is contemplated that slits or notches will be formed in some part of the frame member 30. With such slits or the like in the frame member 30, the exhaust device 10*c* will be capable of operation in a favorable condition even when the entire area enclosed by the frame member is obstructed.

Figure 8:
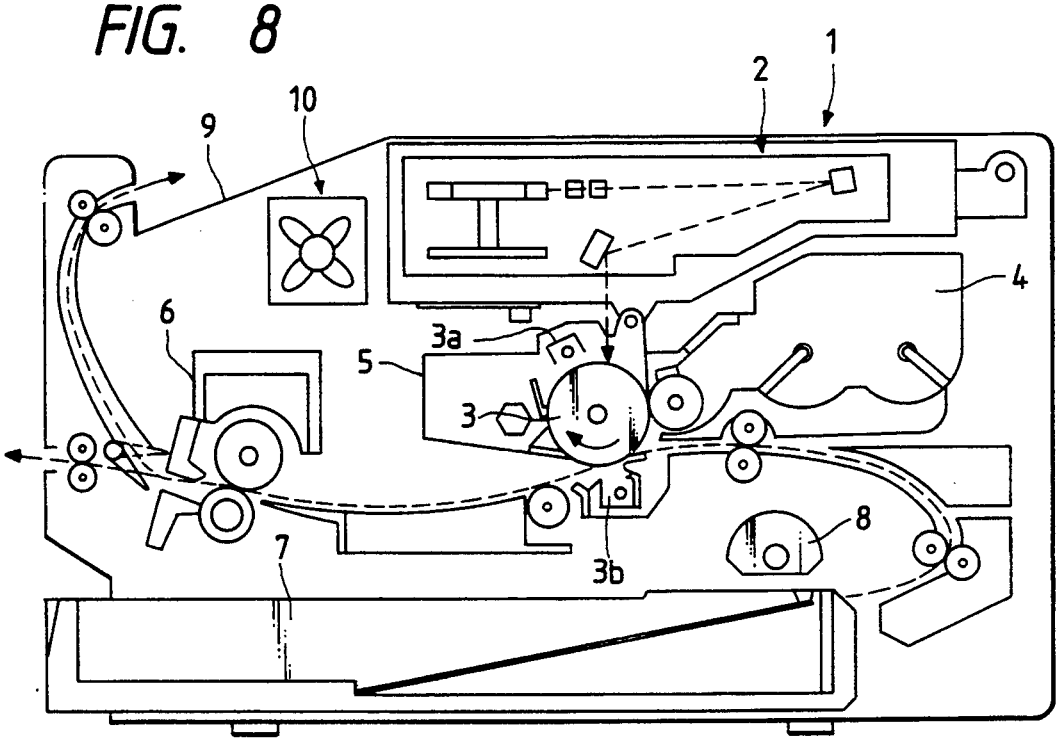
FIG. 8 is a schematic view illustrating the construction of a printer to which the exhaust device according to the present invention can be applied.

An exhaust device of in any of the described embodiments may be provided in an arbitrarily selected picture image forming apparatus, such as an electronic copying machine or a laser printer. For example, an exhaust device of the present invention in a printer 1 is shown in FIG. 8. A single exhaust device 10 for discharging the unified exhaust air stream from all regions on the inside of the printer 1 is installed on a side wall of the printer. The printer 1 is constructed as an apparatus for producing recorded paper by a electrophotographic process and is provided with a writing device 2 for writing picture images, using a laser beam, on a photosensitive material drum 3. The writing device 2 is an apparatus constructed with a laser beam output means, a polygon mirror, a focusing lens, mirrors, etc., as is the case with a conventional laser printer. The writing device 2 scans the photosensitive material drum in the direction of its length by way of a lens and a mirror, causing an oscillating laser beam to be reflected on a polygon mirror.

On the circumference of the photosensitive material drum 3, a charging corotron 3*a*, applies uniform charge to the photosensitive material, and a transferring and separating corotron 3*b* transfers a picture image in toner onto the printing paper also in accordance with conventional printing practice. In addition, a developing unit 4 and a cleaning unit 5 are provided. Upon operation of the writing device 2, to project a laser beam onto the photosensitive material drum, uniformly charged by the charging corotron 3*a*, an electrostatic latent image is formed on the drum. Then the developing unit feeds toner to the electrostatic latent image and thereby forms a picture image in toner. The toner picture image thus formed on the photosensitive material drum 3 is then transferred to printing paper by an electric discharge of the transferring and separating corotron 3*b*. Thereafter, the residual toner on the photosensitive material drum is removed by means of the cleaning device 5, so that the photosensitive material drum will be made ready for its operation for forming the next picture image.

The printing paper is fed out, one sheet after the other from a paper feeding cassette 7 by a paper feeding roller 8 and then passed through a picture image transfer block, in which a picture image in toner is transferred onto the printing paper. Thereafter, the printing paper is passed to a fixing unit 6, in which the transferred picture image in toner is fixed under heat and pressure. The recorded paper is discharged toward a paper discharge tray 6 arranged on the upper surface of the printer. In this regard, the printer 2 is constructed in such a manner that it can also discharge the recorded paper toward another paper discharge tray provided on a side of the printer, in addition to the discharge of the recorded paper to the paper discharge tray 9 arranged on the top of the printer.

In the printer 1 illustrated in FIG. 8, the electric discharge members 3*a* and 3*b* discharge ozone and NOX. A large amount of heat is discharged from the fixing device 6 from the motor for the writing device, and also from the power source unit, the control unit, and the like. In addition, toner clouds and particulate dust, from the developing unit 4 and the cleaning device 5, and paper dust are generated from the transport system for the printing paper. Therefore, the printer features exhaust systems for heat and particulate dust integrated into one exhaust device in a mechanism constructed for a discharge of the heat and the dust to the outside by the exhaust device 10. Moreover, the exhaust device 10 mentioned above is provided with a dust filter and an ozone filter so that the exhaust air discharged to the outside is cleansed of harmful materials.

In case the picture image forming apparatus is of large size, which makes it necessary to provide a plurality of exhaust devices, the picture image forming apparatus may be provided with exhaust devices respectively installed on a side wall or the upper wall of the picture image forming apparatus, each of the exhaust devices being constructed in accordance with the invention.

The exhaust device of the invention, therefore, may be arranged on a side or the top of a picture image forming apparatus, and can be added on to the main frame, with a louver provided for use therewith, and this construction can be formed with some processing of the conventional apparatus without complication. Further, the construction of the exhaust device in the manner described above is capable of securing a margin of space permitting the performance of an exhausting operation even when an object is placed in the proximity of the exhaust device, or when picture image forming apparatus is placed in a position close to a wall or the like. Furthermore, the picture image forming apparatus incorporating the exhaust device according to the present invention can accommodate the exhaust device in an arbitrarily selected position on the main unit frame, with an exhaust port formed in an arbitrarily determined state in relation to the exhaust device to form a passage for the exhaust air. Accordingly, the exhaust device according to the present invention is capable of performing the operations for the discharge of the heat, together with the exhaust air, the dust and the other harmful substances generated inside the picture image forming apparatus to the area outside of the apparatus.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. In a picture image forming apparatus for producing paper recorded with picture images by forming a picture image in toner on a photosensitive body employing an electrophotographic process, transferring the formed picture image in toner onto recording paper, and fixing the recording paper bearing the picture image formed in toner by passing the recording paper through a fixing device, the picture image forming apparatus being provided with an exterior frame and means for discharging heat, particulate dust, and the like, generated inside the picture image forming apparatus, to the outside of the exterior frame, the improvement comprising:

an exhaust device comprising a concave part of the exterior frame and having slits in said concave part for passing exhaust materials through the frame.

2. In a picture image forming apparatus for producing paper recorded with picture images by forming a picture image in toner on a photosensitive body employing an electrophotographic process, transferring the formed picture image in toner onto recording paper, and fixing the recording paper bearing the picture image formed in toner by passing the recording paper through a fixing device, the picture image forming apparatus being provided with an exterior frame and means for discharging heat, particulate dust, and the like, generated inside the picture image forming apparatus, to the outside of the exterior frame, the improvement comprising:

an exhaust device comprising a multiplanar depression in the exterior frame and having slits extending through at least one planar surface portion of said depression for passing exhaust materials through the frame.

* * * * *